US006047715A

United States Patent [19]

Mooney et al.

[11] Patent Number: 6,047,715

[45] Date of Patent: Apr. 11, 2000

[54] TURBULENT CLEANING ACTION FOR INK JET PRINT HEADS AND ORIFICES

[75] Inventors: John E. Mooney; Werner Fassler, both of Rochester; Charles D. DeBoer, Palmyra, all of N.Y.

[73] Assignee: Eastman Kodak Company, Rochester, N.Y.

[21] Appl. No.: 09/216,049

[22] Filed: Dec. 18, 1998

[51] Int. Cl.[7] ..... B08B 3/00

[52] U.S. Cl. ..... 134/122 R; 134/194; 68/202

[58] Field of Search ..... 134/153, 194, 134/157, 138, 122 R, 64 R; 15/77, 88.3, 230.18; 118/227, 407, 415; 68/202

[56] References Cited

U.S. PATENT DOCUMENTS

| | | | |
|---|---|---|---|
| 1,499,879 | 7/1924 | Schmitt et al. . | |
| 1,610,782 | 12/1926 | Homan et al. . | |
| 1,716,270 | 6/1929 | Holmstrom . | |
| 1,941,001 | 12/1933 | Hansell . | |
| 3,306,255 | 2/1967 | Kolibas | 134/122 R |
| 3,373,437 | 3/1968 | Sweet et al. . | |
| 3,416,153 | 12/1968 | Hertz et al. . | |
| 3,650,252 | 3/1972 | Mahoney | 68/202 |
| 3,705,043 | 12/1972 | Zabiak et al. . | |
| 3,776,642 | 12/1973 | Anson et al. . | |
| 3,846,141 | 11/1974 | Ostergren et al. . | |
| 3,849,171 | 11/1974 | Takahashi et al. | 134/122 R |
| 3,870,528 | 3/1975 | Edds et al. . | |
| 3,878,519 | 4/1975 | Easton . | |
| 3,889,269 | 6/1975 | Meyer et al. . | |
| 3,903,034 | 9/1975 | Zabiak et al. . | |
| 3,928,064 | 12/1975 | Holm . | |
| 4,050,982 | 9/1977 | Bolliand et al. | 68/202 |
| 4,346,387 | 8/1982 | Hertz . | |
| 4,557,952 | 12/1985 | Mitch et al. . | |
| 4,648,704 | 3/1987 | O'Leary . | |
| 5,092,961 | 3/1992 | Keller | 162/48 |
| 5,095,928 | 3/1992 | Phipps | 134/138 |
| 5,539,504 | 7/1996 | Hanson . | |
| 5,603,775 | 2/1997 | Sjoberg | 134/21 |

FOREIGN PATENT DOCUMENTS

| | | | |
|---|---|---|---|
| 49309 | 8/1966 | Germany | 134/12 R |

*Primary Examiner*—Frankie L. Stinson
*Attorney, Agent, or Firm*—Raymond L. Owens

[57] ABSTRACT

Cleaning apparatus for cleaning debris from orifices in an ink jet print head orifice plate includes a structure defining a cleaning cavity for receiving cleaning liquid; a roller partially submerged in the cleaning liquid. The roller is rotated so that cleaning liquid coats the roller and is carried by surface tension around the roller; and relative movement is provided between the orifice plate and the structure so that the orifice plate is positioned adjacent to the cleaning cavity with the rotating roller spaced a distance from the orifice plate so that there is turbulence of the cleaning liquid and such turbulence causes the cleaning fluid to engage the orifice plate and remove debris from the orifice plate and orifice nozzles.

5 Claims, 3 Drawing Sheets

TURBULENT CLEANING ACTION FOR INK JET PRINT HEADS AND ORIFICES

CROSS REFERENCE TO RELATED APPLICATIONS

Reference is made to commonly assigned U.S. patent application Ser. No. 09/159,447 filed Sep. 24, 1998, entitled "Cleaning Orifices in Ink Jet Printing Apparatus" to Fassler et al. still pending; U.S. patent application Ser. No. 09/159,979 filed Sep. 24, 1998, entitled "Adjustable Vane Used in Cleaning Orifices in Inkjet Printing Apparatus" now U.S. Pat. No. 5,997,127 to Fassler et al. now U.S. Pat. No. 5,997,127; the disclosures of which are incorporated herein by reference.

FIELD OF THE INVENTION

This invention relates to the cleaning apparatus for cleaning debris from orifices in an ink jet print head orifice plate.

BACKGROUND OF THE INVENTION

Many different types of digitally controlled printing systems of ink jet printing apparatus are presently being used. These ink jet printers use a variety of actuation mechanisms, a variety of marking materials, and a variety of recording media. For home applications, digital ink jet printing apparatus is the printing system of choice because low hardware cost make the printer affordable to every one. Another application for digital ink jet printing uses large format printers. It is a further requirement that these large format printers provide low cost copies with an ever improving quality. Ink jet printing technology is the first choice in today's art. Thus, there is a need for improved ways to make digitally controlled graphic arts media, such as billboards, large displays, and home photos for example, so that quality color images may be made at a high-speed and low cost, using standard or special paper.

Ink jet printing has become recognized as a prominent contender in the digitally controlled, electronic printing arena because of its nonimpact, low-noise characteristics, its use of papers from plain paper to specialized high gloss papers and its avoidance of toner transfers and fixing. Ink jet printing mechanisms can be categorized as either continuous ink jet or droplet on demand ink jet. Continuous ink jet printing dates back to at least 1929. See U.S. Pat. No. 1,941,001 to Hansell.

U.S. Pat. No. 3,373,437, issued to Sweet et al. in 1967, discloses an array of continuous ink jet orifices wherein ink droplets to be printed are selectively charged and deflected towards the recording medium. This technique is known as binary deflection continuous ink jet, and is used by several manufacturers, including Elmjet and Scitex.

U.S. Pat. No. 3,416,153, issued to Hertz et al. in 1966, discloses a method of achieving variable optical density of printed spots in continuous ink jet printing using the electrostatic dispersion of a charged droplet stream to modulate the number of droplets which pass through a small orifice. This technique is used in ink jet printers manufactured by Iris.

U.S. Pat. No. 3,878,519, issued to Eaton in 1974, discloses a method and apparatus for synchronizing droplet formation in a liquid stream using electrostatic deflection by a charging tunnel and deflection plates.

U.S. Pat. No. 4,346,387, issued to Hertz in 1982 discloses a method and apparatus for controlling the electric charge on droplets formed by the breaking up of a pressurized liquid stream at a droplet formation point located within the electric field having an electric potential gradient. Droplet formation is effected at a point in the field corresponding to the desired predetermined charge to be placed on the droplets at the point of their formation. In addition to charging tunnels, deflection plates are used to actually deflect droplets.

Conventional continuous ink jet utilizes electrostatic charging tunnels that are placed close to the point where the droplets are formed in a stream. In this manner individual droplets may be charged. The charged droplets may be deflected downstream by the presence of deflector plates that have a large potential difference between them. A gutter (sometimes referred to as a "catcher") may be used to intercept the charged droplets, while the uncharged droplets are free to strike the recording medium. If there is no electric field present or if the break off point from the droplet is sufficiently far from the electric field (even if a portion of the stream before droplets break off is in the presence of an electric field), then charging will not occur.

The on demand type ink jet printers are covered by hundreds of patents and describe two techniques for droplet formation. At every orifice, (about 30 to 200 are used for a consumer type printer) a pressurization actuator is used to produce the ink jet droplet. The two types of actuators are heat and piezo materials. The heater at a convenient location heats ink and a quantity will phase change into a gaseous steam bubble and raise the internal ink pressure sufficiently for an ink droplet to be expelled to a suitable receiver. The piezo ink actuator incorporates a piezo material. It is said to possess piezo electric properties if an electric charge is produced when a mechanical stress is applied. This is commonly referred to as the "generator effect" "The converse also holds true; an applied electric field will produce a mechanical stress in the material. This is commonly referred to as the "motor effect". Some naturally occurring materials possessing this characteristics are: quartz and tourmaline. Some artificially produced piezoelectric crystals are: Rochelle salt, ammonium dihydrogen phosphate (ADP) and lithium sulphate (LH). The class of materials used for piezo actuators in an ink jet print head possessing those properties includes polarized piezoelectric ceramics. They are typically referred to as ferroelectric materials. In contrast to the naturally occurring piezoelectric crystals, ferroelectric ceramics are of the "polycrystalline" structure. The most commonly produced piezoelectric ceramics are: lead zirconate titanate, barium titanate, lead titanate, and lead metaniobate. For the ink jet print head a ferroelectric ceramic is machined to produce ink chambers. The chamber is water proofed by gold plating and becomes a conductor to apply the charge and cause the piezo "motor effect". This "motor effect" causes the ink cavity to shrink, raise the internal pressure, and generate an ink droplet.

Inks for high speed jet droplet printers must have a number of special characteristics. Typically, water-based inks have been used because of their conductivity and viscosity range. Thus, for use in a jet droplet printer the ink must be electrically conductive, having a resistivity below about 5000 ohm-cm and preferably below about 500 ohm-cm. For good flow through small orifices water-based inks generally have a viscosity in the range between about 1 to 15 centipoise at 25 degree C.

Over and above this, the ink must be stable over a long period of time, compatible with the materials comprising the orifice plate and ink manifold, free of living organisms, and functional after printing. The required functional characteristics after printing are: smear resistance after printing, fast drying on paper, and waterproof when dry. Examples of different types of water-based jet droplet printing inks are found in U.S. Pat. Nos. 3,903,034; 3,889,269; 3,870,528; 3,846,141; 3,776,642; and 3,705,043.

The ink also has to incorporate a nondrying characteristic in the jet cavity so that the drying of ink in the cavity is hindered or slowed to such a degree that through occasional spitting of ink droplets the cavities can be kept open. The addition of glycol will facilitate the free flow of ink through the ink jet. Also it is of benefit if ink additives prevent the ink from sticking to the ink jet print head surfaces. Ink jet printing apparatus typically includes an ink jet print head that is exposed to the various environment where ink jet printing is utilized. The orifices are exposed to all kinds of air born particles. Particulate debris accumulates on the surfaces, forming around the orifices. The ink will combine with such particulate debris to form an interference burr to block the orifice or cause through an altered surface wetting to inhibit a proper formation of the ink droplet. That particulate debris has to be cleaned from the orifice to restore proper droplet formation. This cleaning commonly is achieved by wiping, spraying, vacuum suction, and/or spitting of ink through the orifice. The wiping is the most common application.

Inks used in ink jet printers often have the following problems:

1) they require a large amount of energy to dry after printing;
2) large printed areas on paper usually cockle because of the amount of water present;
3) the printed images are sensitive to wet and dry rub;
4) the compositions of the ink usually require an antibacterial preservative to minimize the growth of bacteria in the ink;
5) the inks tend to dry out in and around the orifices resulting in clogging;
6) the wiping of the orifice plate causes wear on plate and wiper;
7) the wiper itself generates particles that clog the orifice;
8) cleaning cycles are time consuming and slow the productivity of ink jet printers. It is especially of concern in large format printers where frequent cleaning cycles interrupt the printing of an image; and
9) when a special printing pattern is initiated to compensate for plugged or badly performing orifices, the printing rate declines.

Some of these problems may be overcome by the use of polar, conductive organic solvent based ink formulations. However, the use of non-polar organic solvents is generally precluded by their lack of electrical conductivity. The addition of solvent soluble salts can make such inks conductive, but such salts are often toxic, corrosive, and unstable.

SUMMARY OF THE INVENTION

It is an object of the invention to provide an ink jet printing apparatus wherein the cleaning liquid can be effectively used to provide for improved cleaning with a minimum number of parts and operations.

It is a further object of the present invention to provide for cleaning a particulate debris thereby eliminating the need of traditional wiper blades.

These objects are achieved by cleaning apparatus for cleaning debris from orifices in an ink jet print head orifice plate, comprising:

a) a structure defining a cleaning cavity for receiving cleaning liquid;
b) a roller partially submerged in the cleaning liquid;
c) means for rotating the roller so that cleaning liquid coats the roller and is carried by surface tension around the roller; and
d) means for providing relative movement between the orifice plate and the structure so that the orifice plate is positioned adjacent to the cleaning cavity with the rotating roller spaced a distance from the orifice plate so that there is turbulence of the cleaning liquid and such turbulence causes the cleaning fluid to engage the orifice plate and remove debris from the orifices and orifice plate.

ADVANTAGES OF THE INVENTION

Rapid cleaning of orifices and orifice plate in accordance with the present invention can be accomplished in such a short time because of the efficiency of cleaning apparatus in accordance with the present invention.

The cleaning fluid on the roller is replenished at a predetermined rate and removes waste ink and particulate debris permanently from the ink jet print head. Pulsation of pressure variation due to features on the roller provides more effective cleaning of the orifice plate and ink jet orifices. The pressure variation pulses will clean the ink jet orifice without resorting to ink droplet ejection. Ink droplet ejection for the purpose of orifice cleaning causes premature contamination of cleaning fluid and the loss of costly ink.

The feature on the roller also cause a faster exchange of cleaning liquid in the cavity space for improve cleaning.

Another advantage of this invention is that the cleaning fluid on the roller with cavity gap variation can bridge a larger cavity gap.

Another advantage of this cleaning technique is that with no mechanical rubbing, the wear of the delicate orifice plate is eliminated or greatly reduced. The replacement of the ink jet head will be less frequent and more of the orifices will stay functional to result in a higher image quality.

Another advantage is that individual inks can be cleaned by selecting the rotation rate or geometry of the roller to change the turbulence or agitation rate. In this way, the speed and roller geometry can be selected to match the cleaning needs of a particular ink. In other words, red, green, and blue inks in the same cartridge can have different roller geometry and roller speeds.

DETAILED DESCRIPTION OF THE INVENTION

Figure 1:
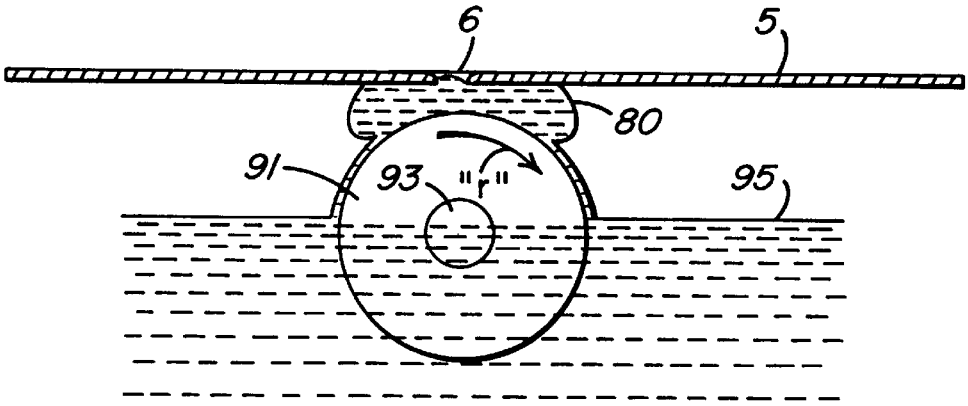
FIG. 1 shows a rotating cleaning roller as a cleaning mechanism inside the cleaning station.

Turning first to FIG. 1, there is shown a cross sectional view of a cleaning roller 91 partially submerged in cleaning liquid. The cleaning roller 91 shows a cross sectional view of rotating (direction shown with an arrow "r") cleaning roller 91 on a shaft 93 that coats itself with cleaning liquid 95 and carries the liquid to fill a cavity space 80 with cleaning liquid 95. The cavity space 80 is established between the ink jet orifice outlet plate 5 and the cleaning roller 91. The agitated cleaning liquid cleans the orifice outlet plate 5 and the outlet ink jet orifice 6 from dried ink and other debris.

Figure 2:
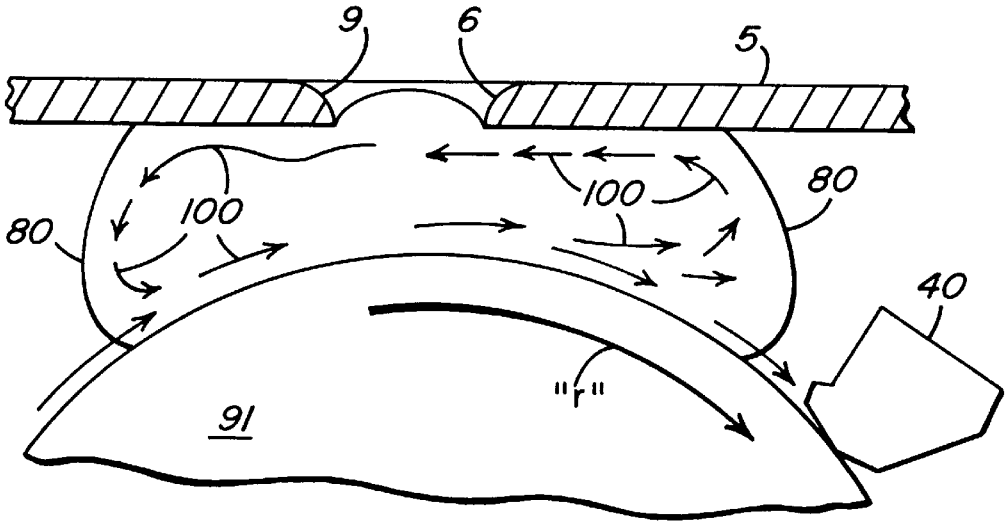
FIG. 2 shows an enlargement of the cleaning action in accordance with the present invention.

FIG. 2 shows the cleaning cavity space 80 in an enlargement to clarify the cleaning action of the cleaning roller 91 and its agitation of the cleaning liquid 95. The cleaning roller 91 rotates as the print head (not shown) is moved into the cleaning station (not shown) so that cleaning liquid coats the cleaning roller 91 and is carried by surface tension by the cleaning roller 91. When the print head orifice outlet plate 5 is in operative relationship with the rotating cleaning roller 91, the cleaning roller 91 is spaced from the orifice outlet plate 5 a distance selected so that there is turbulence of the cleaning liquid where the cleaning liquid 95 engages the orifice outlet plate 5, such turbulence causes the cleaning of the ink jet outlet orifices 9.

Figure 3:
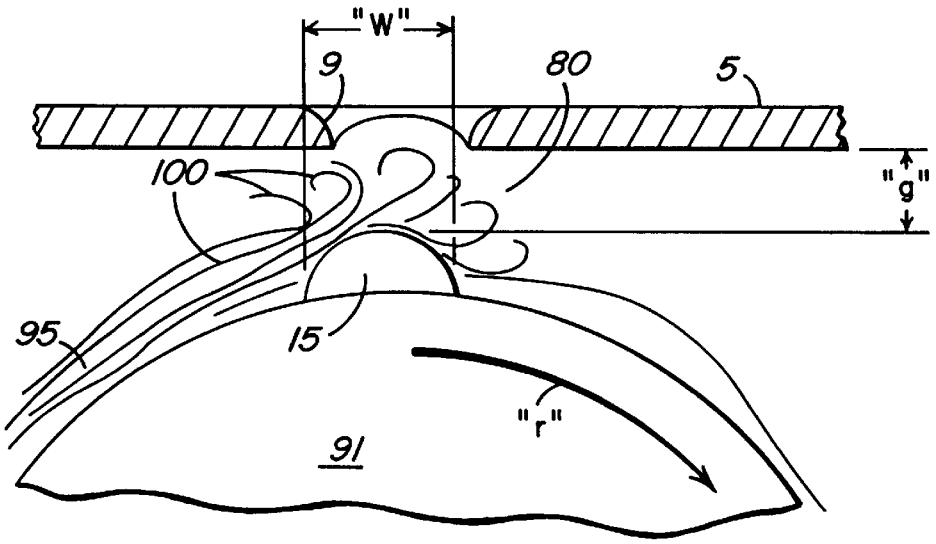
FIG. 3 shows the impact of a dimple and the altered flow of cleaning fluid.

FIG. 3 shows a "pimple" surface protrusion 10 as it engages the ink jet outlet orifice in ink jet orifice outlet plate 5. The surface protrusion 10 with a width shown as dimension "w" will cause great alterations in the cleaning liquid 95 flow patterns. As is indicated with flow lines 100 an upward trusting flow is created to clean the ink jet outlet orifice 9. The fluid pressure in the cavity space 80 is altered by the surface protrusion to generate a pressure variance to cause a pulsating effect on the ink jet outlet orifice 9.

Figure 4:
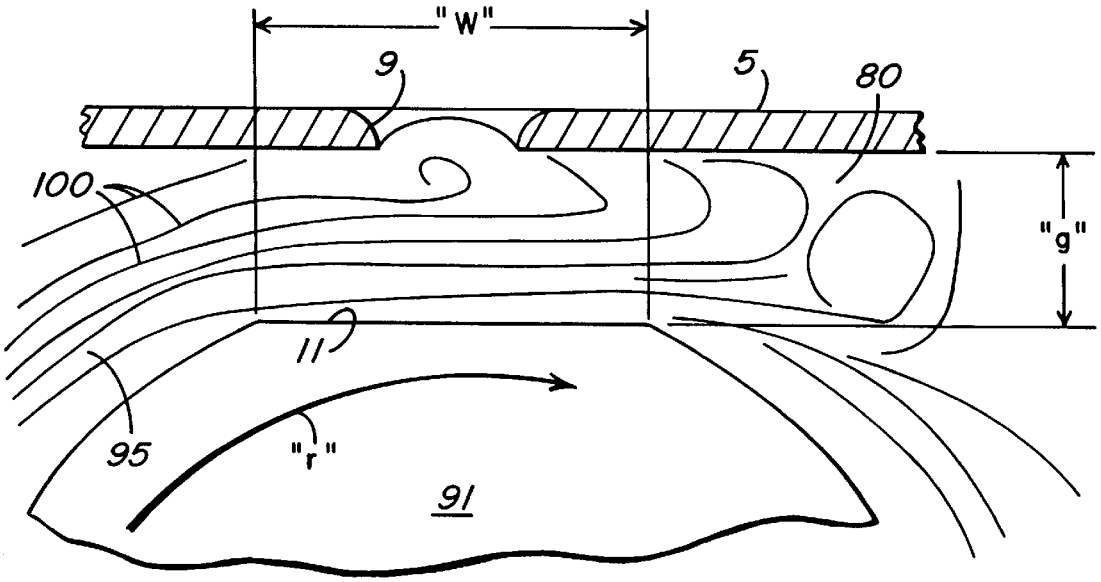
FIG. 4 shows a flat surface which alters the flow of cleaning fluid with associated pressure variations.

FIG. 4 shows how a flat surface 11 of width "w" changes the flow and pressure patterns of cleaning liquid 95. The cavity space 80 is enlarged with the flat surface 11 feature of cleaning roller 91. The rotation indicated by arrow "r" widens the gap shown as dimension "g". This widening decreases the static pressure in the cavity space 80 and causes a pulsating effect to clean the ink jet outlet orifice 9. The width of flat surface 11 shown as dimension "w" can be altered so that the dynamics of roller surface speed and flat width "w" allow enough time for debris to be cleared from the ink jet outlet orifice 9 into the cleaning liquid 95. This has to happen before the pressure increase of the none flat surface portion cause debris to re-contaminate the ink jet outlet orifice 9.

Figure 5:
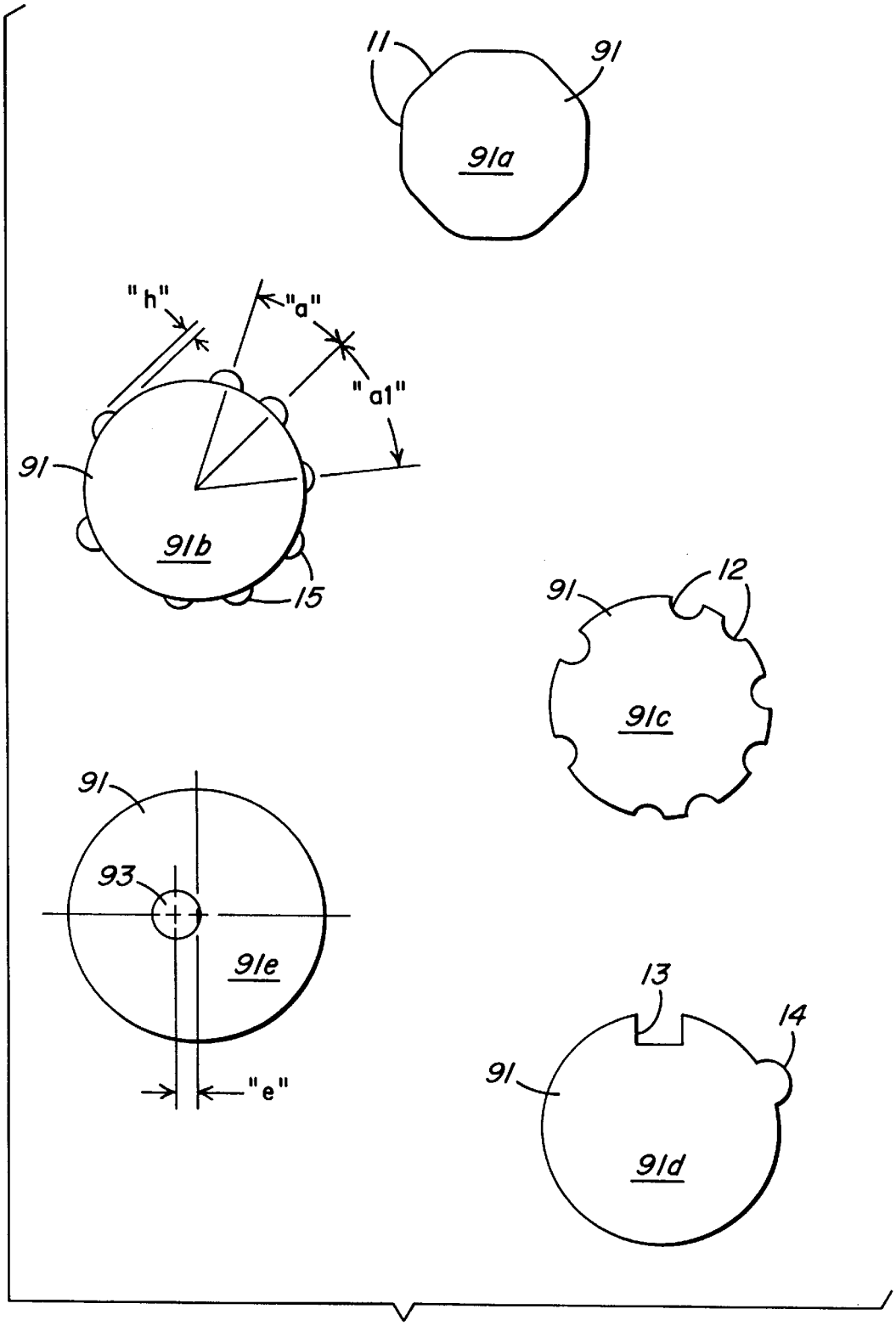
FIG. 5 is a series of various features on alternate modifications of the cleaning roller geometry for a variety of effects to enhance the cleaning.

FIG. 5 shows variations in surface features for the cleaning roller 91. The cleaning roller 91*a* and cleaning roller 91*b* show the cleaning roller 91 with flat surface 11 and protrusions 10. On roller 91*b* it is shown how the height indicated with dim. "h" and the angular spacing indicated as "a" an d"a1" can be altered to cause enhanced cleaning through non uniform flow and pressure variation to accommodated the different cleaning needs for variations in debris. Roller 91*c* includes dimples 15. Roller 91*d* includes rectangular channels 13 and ribs 14. Roller 91*e* shows a roller which is eccentrically mounted and this eccentric feature is indicated by dimension "e". All of the rollers 91*c*, 91*d*, and 91 depict variations in features which can be used to achieve effective cleaning action. Those skilled in the art will appreciate that various design alterations to the rollers 91*a* to 91*e* can be provided in accordance with the present invention.

The invention has been described in detail, with particular reference to certain preferred embodiments thereof, but it should be understood that variations and modifications can be effected with the spirit and scope of the invention.

What is claimed is:

1. Cleaning apparatus for cleaning debris from orifices in an ink jet print head orifice plate, comprising:

a) a structure defining a cleaning cavity for receiving cleaning liquid;

b) a roller partially submerged in the cleaning liquid wherein the roller has its surface shaped to provide increased turbulence of the cleaning fluid when the roller is rotated;

c) means for rotating the roller so that cleaning liquid coats the roller and is carried by surface tension around the roller; and d) means for providing relative movement between the orifice plate and the structure so that the orifice plate is positioned adjacent to the cleaning cavity with the rotating roller spaced a distance from the orifice plate so that there is turbulence of the cleaning liquid and such turbulence causes the cleaning fluid to engage the orifice plate and remove debris from the orifice plate and orifice nozzles.

2. The cleaning apparatus of claim 1 wherein the shaped surface includes flat regions, raised regions, and indented regions or combinations thereof.

3. The cleaning apparatus of claim 1 wherein the roller is rotated about an off-center axis.

4. The cleaning apparatus of claim 1 wherein the surface of the roller has flat surface portions which move into the cleaning liquid to increase the turbulence of the cleaning fluid.

5. The cleaning apparatus of claim 1 wherein the shaped surfaces are selected to increase flow and vary pressure in an alternating sequence to thereby increase turbulence and enhance cleaning in the orifices.

* * * * *